United States Patent [19]

Hickey

[11] Patent Number: 5,010,910

[45] Date of Patent: Apr. 30, 1991

[54] STEAM DISTRIBUTION MANIFOLD

[75] Inventor: Patrick J. Hickey, Paso Robles, Calif.

[73] Assignee: Mobil Oil Corporation, Fairfax, Va.

[21] Appl. No.: 526,475

[22] Filed: May 21, 1990

[51] Int. Cl.[5] ..... F16K 51/00; E21B 43/24

[52] U.S. Cl. ..... 137/1; 137/561 A

[58] Field of Search ..... 137/561 A, 561 R, 1, 137/2

[56] References Cited

U.S. PATENT DOCUMENTS

| | | | |
|---|---|---|---|
| 2,144,898 | 1/1939 | Shrode | 137/561 A X |
| 3,899,000 | 8/1975 | Ohlswager et al. | 137/561 A |
| 4,269,211 | 5/1981 | Howard et al. | 137/2 |
| 4,505,297 | 3/1985 | Leech, III et al. | 137/561 A |
| 4,528,919 | 7/1985 | Harbolt et al. | 137/561 A X |
| 4,574,837 | 3/1986 | Aggour et al. | 137/561 A |
| 4,800,921 | 1/1989 | Greebe | 137/561 A |

*Primary Examiner*—John Rivell

*Attorney, Agent, or Firm*—A. J. McKillop; C. J. Speciale; M. J. Mlotkowski

[57] ABSTRACT

A manifold for dividing a single, two-phase mixed stream of vapor and liquid into a plurality of individual streams of substantially uniform quality. The manifold comprises: a flow disperser having an inlet port for receiving the vapor-liquid mixture and at least two outlet ports; at least two hollow runners, each runner having a first end in fluid communication with one of the outlet ports of the flow disperser and a second end; a substantially toroidal manifold shell having at least two fluid receiver ports in fluid communication with each of the second ends of the runners, the manifold shell defining a manifold chamber; and a plurality of distribution ports spaced about the substantially toroidal manifold shell, each distribution port in fluid communication with the manifold chamber of the toroidal manifold shell; wherein the vapor-liquid mixture emanating from each distribution port of the manifold is of substantially uniform quality. A method for uniformly distributing a vapor-liquid mixture is also provided.

17 Claims, 3 Drawing Sheets

STEAM DISTRIBUTION MANIFOLD

FIELD OF THE INVENTION

The present invention relates to an apparatus and method for dividing a single, two-phase mixed stream of vapor and liquid into a plurality of individual uniform quality streams. More particularly, the present invention employs a manifold of toroidal configuration which receives a single two-phase mixed stream from a supply line and divides it into a plurality of streams for distribution therefrom.

BACKGROUND OF THE INVENTION

There are many oil-bearing subterranean formations from which the resident oil cannot be recovered in economic quantities by primary recovery techniques. In these formations, secondary recovery techniques must be employed to enable the oil to be produced in economic quantities. One of the secondary recovery techniques which has been found to be well-suited for use in these formations is known generally as steam stimulation. In this technique, steam is injected into the formation for a period of time until the formation is heated sufficiently well so that the viscosity of the oil contained therein is reduced to a degree that it may be readily produced.

Fundamentally, water can exist as either a gas or a liquid under saturated conditions. Wet steam can contain both gas and liquid components, known to those skilled in the art as two-phase flow. A common method of expressing the quantities of each phase, known as quality, is the ratio of the mass flow rate of the gas phase to the total mass flow rate, expressed as a number less than one or as a percentage. Another expression of steam quality is the use of the ratio of vapor to liquid.

In thermally enhanced oil recovery projects it is common to employ a high quality, two-phase steam which may be prepared for convenience at a central steam generating facility. As is well known to those skilled in the art, the practice of utilizing a high quality, two-phase steam is necessitated by the use of low quality, brackish waters having at least a moderate level of dissolved solids. To prevent deposition of salts on the surface of the steam generator tubes, it is necessary to retain part of the flow in a liquid state in order to maintain the solids and other impurities in solution. As can be appreciated, should the steam so generated be required to be distributed to a plurality of injection wells from a single generator output line, it is essential that this plurality of individual flows be maintained at a consistent and desirable vapor-to-liquid ratio. The problem which exists in the distribution of a two-phase mixed stream of vapor and liquid to a plurality of locations is that without special provisions, the vapor and liquid components will not divide into flows of uniform vapor-to-liquid ratio.

Several attempts have been made to provide an apparatus for distributing a two-phase mixed stream of vapor and liquid. For example, U.S. Pat. No. 3,899,000 provides a closed vessel structure for the separation of a two-phase vapor-liquid mixture into two or more individual flows. The vessel disclosed is mounted vertically and provided with a top inlet and two or more bottom outlets. A flat, horizontal baffle is used to divert the inlet flow from the open ends of the outlets. The axis of the inlet and the axis of the outlets are substantially parallel so that the flow of the fluid is axially through the elongated vessel. It is taught that the vapor-to-liquid ratio is maintained by using the outlets as standpipes and the vessel as a reservoir. Once sufficient liquid collects in the bottom of the vessel, it can overflow the side outlets in the standpipes and liquid will be added to the vapor flowing out of the outlets.

U.S. Pat. No. 4,269,211 discloses a method for equalizing the steam quality in a plurality of branch lines of a high pressure steam pipeline. Also disclosed is a steam manifold distribution system which includes a mechanism for retracting a perforated baffle plate into a pressure equalizer chamber for removal, repair or replacement of the baffle plate. The pressure equalizer chamber of U.S. Pat. No. 4,269,211 may be positioned on and fixedly attached to a tee joint in the the field in any position between and coaxial with one of the branch lines of the tee joint and perpendicular thereto.

U.S. Pat. No. 4,505,297 discloses an apparatus for dividing a single stream vapor-liquid mixture into a plurality of individual streams while maintaining a similar vapor-to-liquid ratio in the individual streams. The apparatus taught comprises a closed vessel having a central inlet in the top for the inlet feedstream and a plurality of outlets in the side of the vessel for the individual streams. A frustrum-shaped diverting member is mounted in the center of the vessel to divert the flow of the single feedstream into the individual streams. A bottom drain is disclosed for use in removing any liquid that is separated from the vapor-liquid mixture.

U.S. Pat. No. 4,800,921 teaches the utilization of a gravity influenced liquid distribution system in an annular flow regime within a substantially horizontal header which receives a liquid vapor mixture from a supply line and divides that single stream into a plurality of streams for distribution through a branchline to a nearby site. The header employed is substantially horizontal, with each branchline connected to the periphery of the header further downstream and relatively lower on the periphery of the header than the preceding branchline.

Despite these advances in the art, there exists a need for an improved steam manifold and distribution system capable of uniformly distributing steam throughout a field through a plurality of steam distribution lines.

SUMMARY OF THE INVENTION

According to the present invention, there is provided a manifold for dividing a single, two-phase mixed stream of vapor and liquid into a plurality of individual streams of substantially uniform quality. The manifold comprises: a flow disperser having an inlet port for receiving the vapor-liquid mixture and at least two outlet ports; at least two hollow runners, each runner having a first end in fluid communication with one of the outlet ports of the flow disperser and a second end; a substantially toroidal manifold shell having at least two fluid receiver ports in fluid communication with each of the second ends of the runners, the manifold shell defining a manifold chamber; and a plurality of distribution ports spaced about the substantially toroidal manifold shell, each distribution port in fluid communication with the manifold chamber of the toroidal manifold shell; wherein the vapor-liquid mixture emanating from each distribution port of the manifold is of substantially uniform quality.

A method for dividing a two-phase mixed stream of vapor and liquid into a plurality of individual streams of substantially uniform quality is also provided. The method comprises the steps of: feeding a two-phase mixed stream of vapor and liquid at a first velocity into a generally toroidally configured steam distribution manifold along a first axis; diverting the two-phase mixed stream of vapor and liquid along a second axis; increasing the velocity of the diverted two-phase mixed stream to a second velocity; and dividing the two-phase mixed stream of vapor and liquid into a plurality of individual streams of substantially uniform quality.

Therefore, it is an object of the present invention to provide a manifold for dividing a single, two-phase mixed stream of vapor and liquid into a plurality of individual streams having substantially uniform vapor-to-liquid ratios.

Another object of the present invention resides in the provision of a manifold for distributing uniform quality wet steam from a single trunk line to multiple steam injector sites which is capable of effective use in an oil field environment.

Yet another object of the present invention is to provide a manifold for dividing a single vapor-liquid mixture stream into a plurality of individual streams of substantially uniform quality which is of simple configuration and easy to fabricate.

Still another object of the present invention is the provision of a manifold for distributing uniform quality wet steam from a single trunk line to multiple steam injector sites which is easy to operate and requires little maintenance.

It is a further object of the present invention to provide a method for uniformly dividing a single vapor-liquid mixture stream into a plurality of individual streams of substantially uniform quality.

Other objects and the several advantages of the present invention will become apparent to those skilled in the art upon a reading of the specification and the claims appended thereto.

DETAILED DESCRIPTION OF THE PRESENT INVENTION

Figure 1:
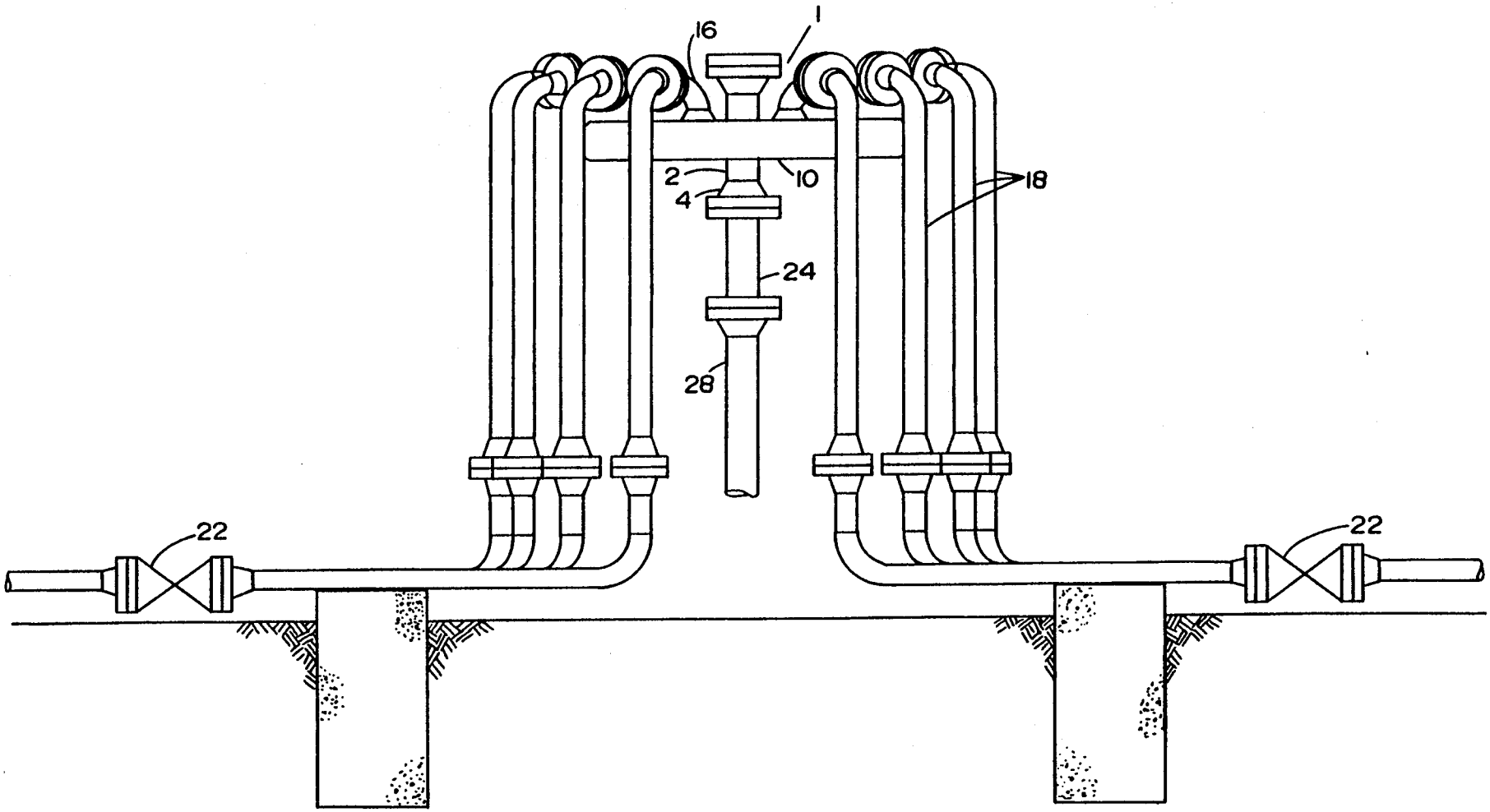
FIG. 1 is a side elevational view of a steam distribution manifold in accordance with the present invention.

The present invention is best understood by reference to the appended figures, which are given by way of example and not of limitation. Referring now to FIG. 1, a side elevational view of steam distribution manifold 1, is shown. In operation, wet steam is fed through trunk line 28 to centrally located steam inlet port 4 of steam distribution manifold 1 where it travels to flow disperser 2 for horizontal diversion to toroidal manifold shell 10. As can be envisioned by reference to FIG. 3, the interior surface of toroidal manifold shell !0 defines manifold chamber 14. The vapor-liquid mixture is drawn from manifold chamber 14 in response to various field injector requirements through a plurality of distribution ports 16. As is preferred, distribution ports 16 can be advantageously located on the upper peripheral surface of toroidal manifold shell 10. The vapor-liquid mixture then passes through distribution legs 18 to individual injection wells (not shown). It is preferred that distribution ports 16 each have the same diameter, with the flow from each leg 18 to the individual wells controlled by metering valves 22.

Optionally, steam distribution manifold 1 can employ a static mixer 24, preferably located directly below steam inlet port 4. Such a mixer, as those skilled in the art recognize, is designed to thoroughly distribute the liquid of the vapor-liquid mixture throughout the fluid. An example of such a mixer is the Komax® Triple Action Motionless Mixer, marketed by Komax Systems, Inc. of Long Beach, Calif.

Figure 2:
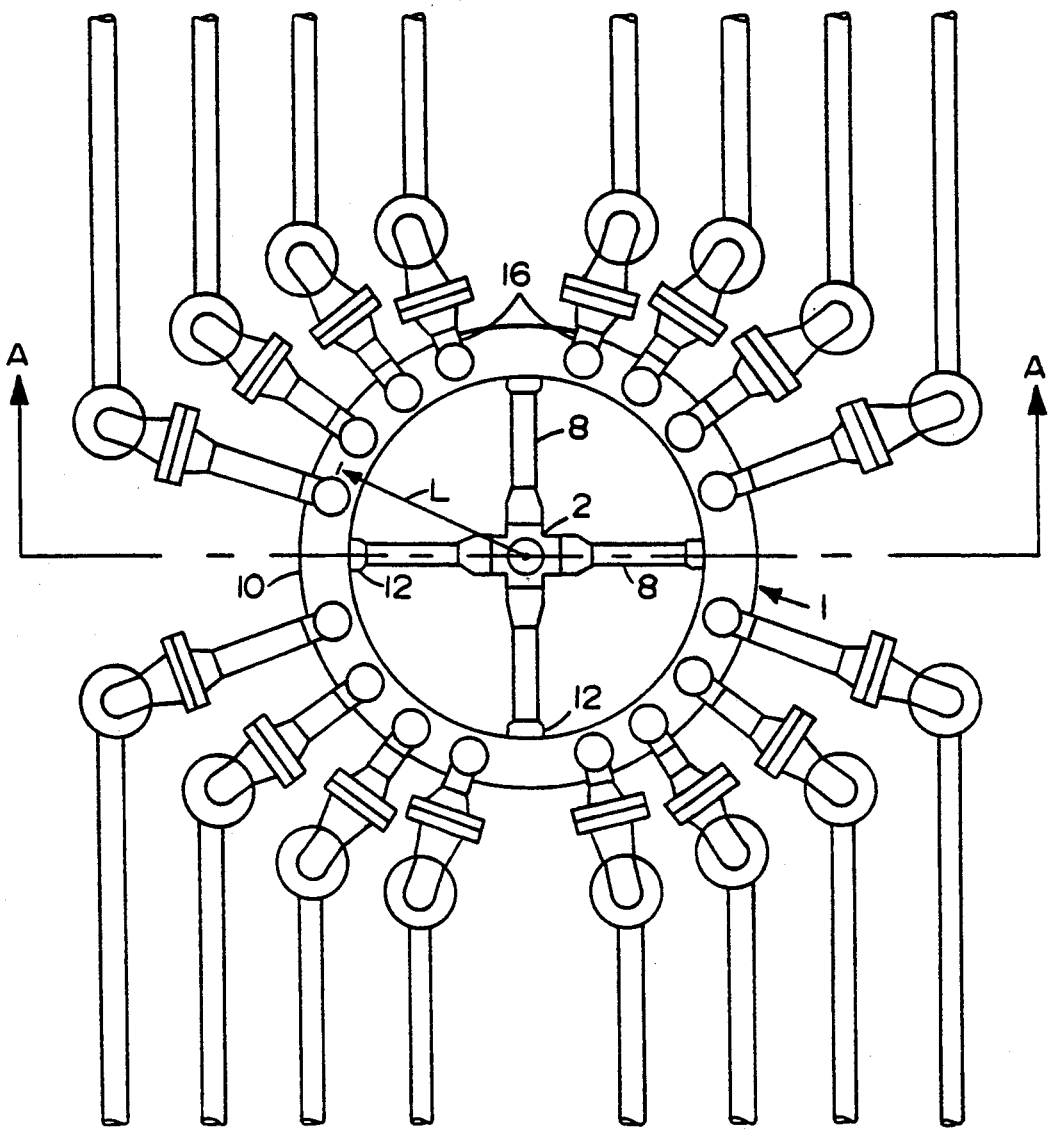
FIG. 2 is a top plan view of the steam distribution manifold of FIG. 1.

Referring now to FIG. 2, a top plan view of steam distribution manifold 1 is presented. As can be seen, flow disperser 2 diverts the vapor-liquid feedstream horizontally through outlet ports 6 to hollow runners 8 which are in fluid communication with fluid receiver ports 12 of toroidal manifold shell 10. To achieve uniform flow and distribution of the vapor-liquid mixture, it is preferred that at least two runners 8 be employed to feed the vapor-liquid stream into manifold chamber 14 of toroidal manifold shell 10; with four runners 8, spaced uniformly about toroidal manifold shell 10, as is shown, still more preferred. It is also preferred that distribution ports 16 be spaced uniformly about the sectors of the toroidal manifold shell 10. The term sector refers to that portion of the toroidal manifold shell 10 defined by radial lines through any two adjacent fluid receiver ports 12. As can be appreciated by those skilled in the art, it is advantageous not to locate a distribution port 16 directly adjacent a fluid receiver port 12 and, for this reason, the manifold depicted in FIG. 2 does not employ uniform distribution port 16 spacing about the circumference of toroidal manifold shell 10; but rather employs uniform spacing within each sector, as preferred.

Figure 3:
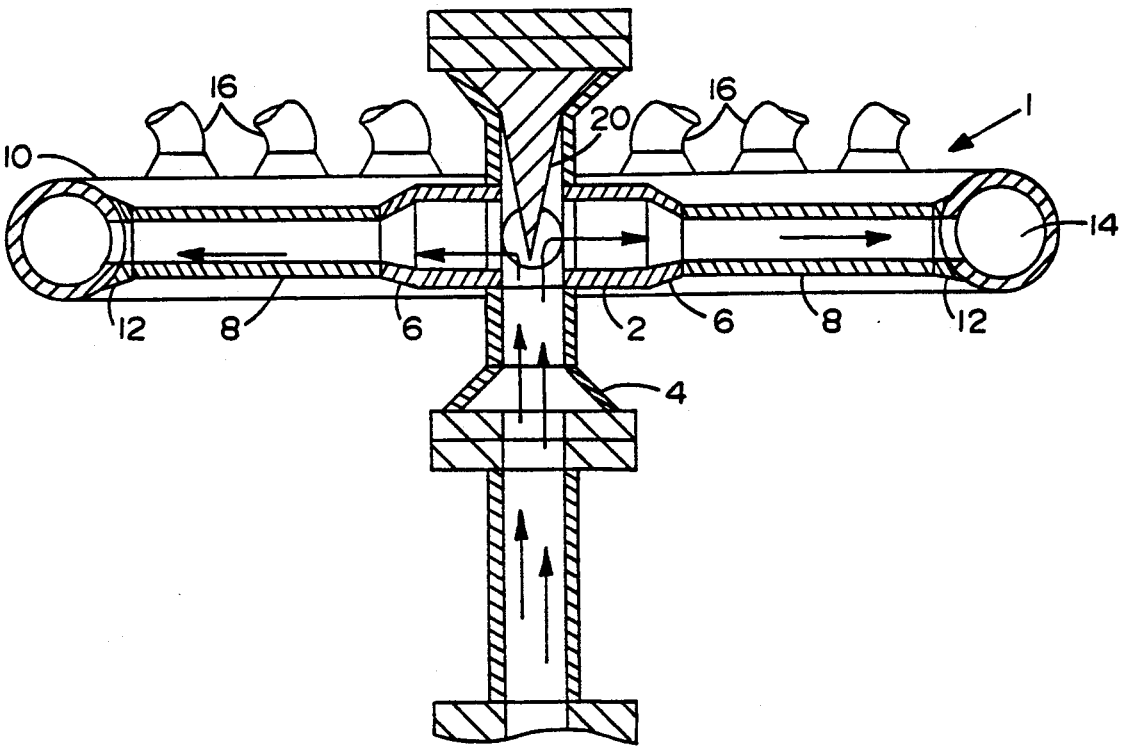
FIG. 3 is an enlarged fragmentary sectional view taken along the line A—A of FIG. 2.

Referring now to FIG. 3, an enlarged fragmentary section taken along the line A—A of FIG. 2 is shown. As can be envisioned, wet steam, mixed and channeled, will flow up to steam inlet port 4 where it then travels to flow disperser 2 for horizontal diversion to outlet ports 6 and runners 8. Shown within flow disperser 2 is diverting member 20. Diverting member 20 serves to divide the flow evenly among the runners 8 without inducing excessive amounts of turbulence to the flow stream. As is preferred, diverting member 20 can be a substantially conical structure, although structures having other configurations may have utility in this application. As can be appreciated, a diverting member of generally frustrum shape could be fabricated form sheet metal stock to have flat sides, for example three or more. To enable runners 8 to exhibit substantially equal pressure drops across their respective lengths, it was found that the flow rate of the vapor-liquid mixture through each runner 8 must exceed that found within the manifold chamber 14 of toroidal manifold shell 10. To achieve this phenomena, it was found necessary to obtain a Reynolds number 20% higher than that of trunk line 28 (see FIG. 1). The high resulting pressure drop allows for the uniform flow of the vapor-liquid mixture about manifold chamber 14 of toroidal manifold shell 10, even at the points where the mixture is being withdrawn from manifold 1 for downstream field use. The increased velocity also insures that the mixture travels about manifold chamber 14 of toroidal manifold shell 10 in a mist flow pattern, a pattern most ideal for maintaining even quality within manifold 1.

Reference is again made to FIG. 2. By providing toroidal manifold shell 10 with a relatively tight radius L excellent mixing of the vapor-liquid fluid is achieved.

The degree of turbulence provided aids in the prevention of flow conditions which could cause separation or stratification of the vapor-liquid mixture. Such a configuration also improves the flow response to changes in steam injector line feed demands.

The invention is further by the following non-limiting example.

EXAMPLE

A steam distribution manifold was built in accordance with the present invention, substantially as shown in the appended FIGS. 1-3. The manifold was designed to distribute uniform quality wet steam to 16 steam injector lines employed in a particular oil field from a 4" diameter steam trunk line. Toroidal manifold shell 10 was fabricated from 6" diameter steel tubing and provided with a radius L of approximately 2'. Flow disperser 2 was constructed from a 4" schedule 80 cross and fitted with a substantially conical diverting member 20. Four 4"×2" concentric reducers were installed on flow disperser 2, to serve as outlet ports 6. Runners 8 were fabricated using 2" diameter schedule 160 pipe. Such dimensioning provided the requisite pressure drop to achieve uniform flow. Fluid receiver ports 12 were constructed using 6"×2" concentric reducers. All 16 steam injector lines had diameters of 3". The manifold was installed and found to uniformly distribute the vapor-liquid wet steam mixture, with minimal variance in vapor-to-liquid ratio observed.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A manifold for dividing a single, two-phase mixed stream of vapor and liquid into a plurality of individual streams of substantially uniform quality, comprising:

(a) a flow disperser having an inlet port for receiving the vapor-liquid mixture and at least two outlet ports;

(b) at least two hollow runners, each runner having a first end in fluid communication with one of said outlet ports of said flow disperser and a second end;

(c) a substantially toroidal manifold shell having at least two fluid receiver ports in fluid communication with each of said second ends of said runners, said manifold shell defining a manifold chamber; and (d) a plurality of distribution ports spaced about said substantially toroidal manifold shell, each distribution port in fluid communication with said manifold chamber of said toroidal manifold shell;

wherein the vapor-liquid mixture emanating from each said distribution port of the manifold is of substantially uniform quality.

2. The manifold of claim 1, wherein said flow disperser further includes a substantially conical diverting member.

3. The manifold of claim 2, wherein said diverting member is axially aligned with said inlet port of said flow disperser.

4. The manifold of claim 3, wherein said flow disperser includes at least four outlet ports.

5. The manifold of claim 2, wherein said flow disperser includes at least four outlet ports.

6. The manifold of claim 1, wherein said flow disperser includes at least four outlet ports.

7. The manifold of claim 6, wherein said outlet ports of said flow disperser are perpendicularly aligned with said inlet port of said flow disperser.

8. The manifold of claim 1, wherein said outlet ports of said flow disperser are perpendicularly aligned with said inlet port of said flow disperser.

9. The manifold of claim 1, further comprising a static mixer located below said inlet port of said flow disperser.

10. A method for distributing a two-phase mixed stream of vapor and liquid of substantially uniform quality to multiple injector sites, comprising the steps of:

(a) feeding a two-phase mixed stream of vapor and liquid into a generally toroidally configured steam distribution manifold, the steam distribution manifold including:

(i) a flow disperser having an inlet port for receiving the vapor-liquid mixture and at least two outlet ports;

(ii) at least two hollow runners, each runner having a first end in fluid communication with one of the outlet ports of the flow disperser and a second end;

(iii) a substantially toroidal manifold shell having at least two fluid receiver ports in fluid communication with each of the second ends of the runners, the manifold shell defining a manifold chamber; and (iv) a plurality of distribution ports spaced about the substantially toroidal manifold shell, each distribution port in fluid communication with the manifold chamber of the toroidal manifold shell; and (b) distributing the two-phase mixed stream of vapor and liquid from the distribution ports of the steam distribution manifold to a plurality of injector sites.

11. The method of claim 10, wherein the flow disperser further includes a substantially conical diverting member.

12. The method of claim 11, wherein the diverting member is axially aligned with the inlet port of the flow disperser.

13. The method of claim 12, wherein the flow disperser includes at least four outlet ports.

14. The method of claim 11, wherein the flow disperser includes at least four outlet ports.

15. The method of claim 10, wherein the flow disperser includes at least four outlet ports.

16. The method of claim 15, wherein the outlet ports of the flow disperser are perpendicularly aligned with the inlet port of the flow disperser.

17. The method of claim 10, wherein the outlet ports of the flow disperser are perpendicularly aligned with the inlet port of the flow disperser.

* * * * *